US005848568A

United States Patent [19]

Imanishi

[11] Patent Number: 5,848,568

[45] Date of Patent: Dec. 15, 1998

[54] DEVICE FOR DRIVING A SLIDE IN A LINK PRESS

[75] Inventor: Shozo Imanishi, Kanagawa, Japan

[73] Assignee: Aida Engineering Co., Ltd., Japan

[21] Appl. No.: 892,803

[22] Filed: Jul. 15, 1997

[30] Foreign Application Priority Data

Oct. 28, 1996 [JP] Japan ..... 8-302482

[51] Int. Cl.[6] ..... B30B 1/06

[52] U.S. Cl. ..... 100/257; 72/446; 72/450; 72/452.5; 83/530; 83/626; 100/282; 100/285; 425/451.6

[58] Field of Search ..... 100/281–283, 100/285, 286, 292, 257; 72/450, 451, 446, 452.5; 83/530, 626, 630; 425/451.6

[56] References Cited

U.S. PATENT DOCUMENTS

| | | | |
|---|---|---|---|
| 1,696,849 | 12/1928 | Kelleher | 72/451 |
| 4,160,409 | 7/1979 | Portmann | 100/257 |
| 5,317,893 | 6/1994 | Eigenmann et al. | 100/257 |
| 5,531,160 | 7/1996 | Eigenmann | 100/285 |

FOREIGN PATENT DOCUMENTS

| | | | |
|---|---|---|---|
| 2-28393 | 2/1990 | Japan . | |
| 2-165900 | 6/1990 | Japan | 100/257 |
| 7-132400 | 5/1995 | Japan . | |
| 7-55399 | 6/1995 | Japan . | |
| 7-121474 | 12/1995 | Japan . | |
| 7-56148 | 12/1995 | Japan . | |
| 8-118082 | 5/1996 | Japan . | |
| 8-118095 | 5/1996 | Japan . | |

*Primary Examiner*—Stephen F. Gerrity
*Attorney, Agent, or Firm*—Morrison Law Firm

[57] ABSTRACT

A link mechanism for driving a slide in a machine press has a pivot pin with an adjustable position for varying the die height and the stroke length of the slide. A first link of the link mechanism is connected to a sliding member which is restricted to vertical movement in a groove. Another end of the first link is pivotally connected to a second link and a third link. Another end of the second link is pivotally connected to the pivot pin. Another end of the third link is connected to a plunger which is connected to the slide. The plunger is movably held in the machine press and restricted to vertical movement. The up and down motion of the sliding member is translated through the first link, second link, and third link into the up and down movement of the plunger and the slide.

15 Claims, 7 Drawing Sheets

DEVICE FOR DRIVING A SLIDE IN A LINK PRESS

BACKGROUND OF THE INVENTION

The present invention relates to a driving mechanism for a slide in a machine press. More specifically, the present invention relates to a link mechanism for driving a slide in a link-type machine press (link press) having an adjustable slide stroke length and an adjustable die height.

There are many prior art patent applications related to devices for driving the slide of a press using bell-crank type links. A typical example of the prior art devices is Japanese Utility Model Laid-open Publication Number 3-81294. In that example, the number of links is relatively small and the overall device is compact.

Referring to FIG. 7, a prior art link press 100 includes a pair of bell-crank shaped links 101. Each bell-crank shaped link 101 pivots about a pivot hinge 102. One end of each bell-crank shaped link 101 is connected to a small end of a connecting rod 105. Another end of connecting rod 105 is connected to an eccentric portion of a crank shaft 107. The small end of connecting rod 105 slides vertically within a groove 106 when a crankshaft 107 is rotated. Another end of each bell-crank shaped link 101 connects to a guide rod 104. Guide rods 104 are connected to a slide 103 of link press 100. When crankshaft 107 is rotated, bell-crank shaped links pivot causing guide rods 104 to move slide 103 up and down in link press 100.

In this conventional technology, the minimum distance between guide rods 104 fixed to slide 103 is limited to the size of the bell-crank shaped links 101 which is directly related to the stroke length required for slide 103. In addition, the pivot hinge 102 for each of triangular bell-crank shaped links 101 is positioned at an upper section of link press 100. Therefore, this prior art press requires a large vertical dimension. The conventional technology described above also lacks an adjustable slide stroke length and an adjustable die height.

OBJECTS AND SUMMARY OF THE INVENTION

An object of the present invention is to provide a link press which overcomes the drawbacks of the prior art.

Another object of the present invention is to provide a link press having an adjustable slide stroke length.

Another object of the present invention is to provide a link press that has a small distance between guide rods ("plungers") fixed to a slide.

A further object of the present is to provide a link press with an adjustable die height.

Briefly, a link mechanism for driving a slide in a machine press has a pivot pin with an adjustable position. A first link of the link mechanism is connected to a sliding member which is restricted to vertical movement in a groove. Another end of the first link is pivotally connected to a second link and a third link. Another end of the second link is pivotally connected to the pivot pin. Another end of the third link is connected to a plunger which is connected to the slide. The plunger is movably held in the machine press and restricted to vertical movement. The up and down motion of the sliding member is translated through the first link, second link, and third link into the up and down movement of the plunger and the slide.

According to an embodiment of the present invention, there is provided, a link mechanism for driving a slide in a machine press comprising: a first portion of said link mechanism vertically movably connected to a frame of said machine press, a connecting rod having one end connected to said first portion and another end connected to a crankshaft of said machine press, whereby a rotational motion of said crankshaft is transformed into a vertical movement of said first portion, a second portion of said link mechanism pivotally connected to a pivot pin of said frame, a position of said pivot pin being adjustable to one of at least a first position and a second position relative to said frame, a plunger vertically movably mounted in said frame, a third portion of said link mechanism connected to a top of said plunger, a bottom of said plunger being connected to said slide, and a stroke length and height of said slide being dependent upon said position of said pivot pin.

According to another embodiment of the present invention, there is provided, a link mechanism for driving a slide in a machine press, comprising: one end of a first link connected to an end of a connecting rod of said machine press, said one end of said first link being vertically movably connected in a frame of said machine press, a second link, a third link, another end of said first link being pivotally connected to one end of said second link and one end of said third link, another end of said second link being pivotally connected to a pivot pin mounted in said frame, and another end of said third link being pivotally connected to a plunger which is vertically movably connected in said frame, a bottom of said plunger being connected to said slide, such that an up and down motion of said one end of said first link is translated into an up and down motion of said plunger and said slide.

According to another embodiment of the present invention, there is provided, machine press having a device for driving a slide in said machine press, comprising: a chassis, a crankshaft rotatably disposed on said chassis, one end of a connecting rod connected of said crank shaft, another end of said connecting rod vertically movably connected to said chassis, a first link mechanism, said first link mechanism including, a first portion of said first link mechanism connected to said another end of said connecting rod, a first pivot pin disposed on said chassis, a position of said first pivot pin being adjustable to one of at least a first position and a second position relative to said machine press, a second portion of said fist link mechanism pivotally connected to said pivot pin, a plunger fixed to said slide and guided by said chassis, a third portion of said first link mechanism connected to a top of said plunger such that and up and down motion of said first portion is translated to an up and down motion of said plunger and said slide, a stroke length and height of said slide being dependent on said position of said first pivot pin.

According to yet another embodiment of the present invention, there is provided, device for driving a slide in a press that uses links comprising: a crank shaft rotatably disposed on a chassis of said press, a connecting rod connected to a large end of said crank shaft, a first slider movably guided by a groove disposed on said chassis above said crank shaft and connected to a small end of said connecting rod, a first link connected to said slider, a second link and a third link connected to the other end of said first link, a second slider connected to the other end of said second link, a plunger fixed to said slide and guided by said chassis, said plunger being connected to the other end of said third link, and a position of said second slider being adjustable on said chassis between at least a first position and a second position on said chassis such that a stroke length and a height of said slide are dependent on said position of said pivot pin.

Thus, the present invention could be referred to as an improvement over the conventional technology described above. In the present invention, a link mechanism using straight links is used in place of the prior art link mechanisms which use bell-crank shaped links. In addition, a pivot position for the links is made adjustable.

The present invention makes it possible to decrease the distance between guide rods ("plungers") compared to the prior art. The present invention also makes it possible to change the stroke length of the slide as well as the bottom dead point of the slide simultaneously, even while the device is operating. Dynamic balancing of the slide is also possible because each side of the slide is independently adjustable.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
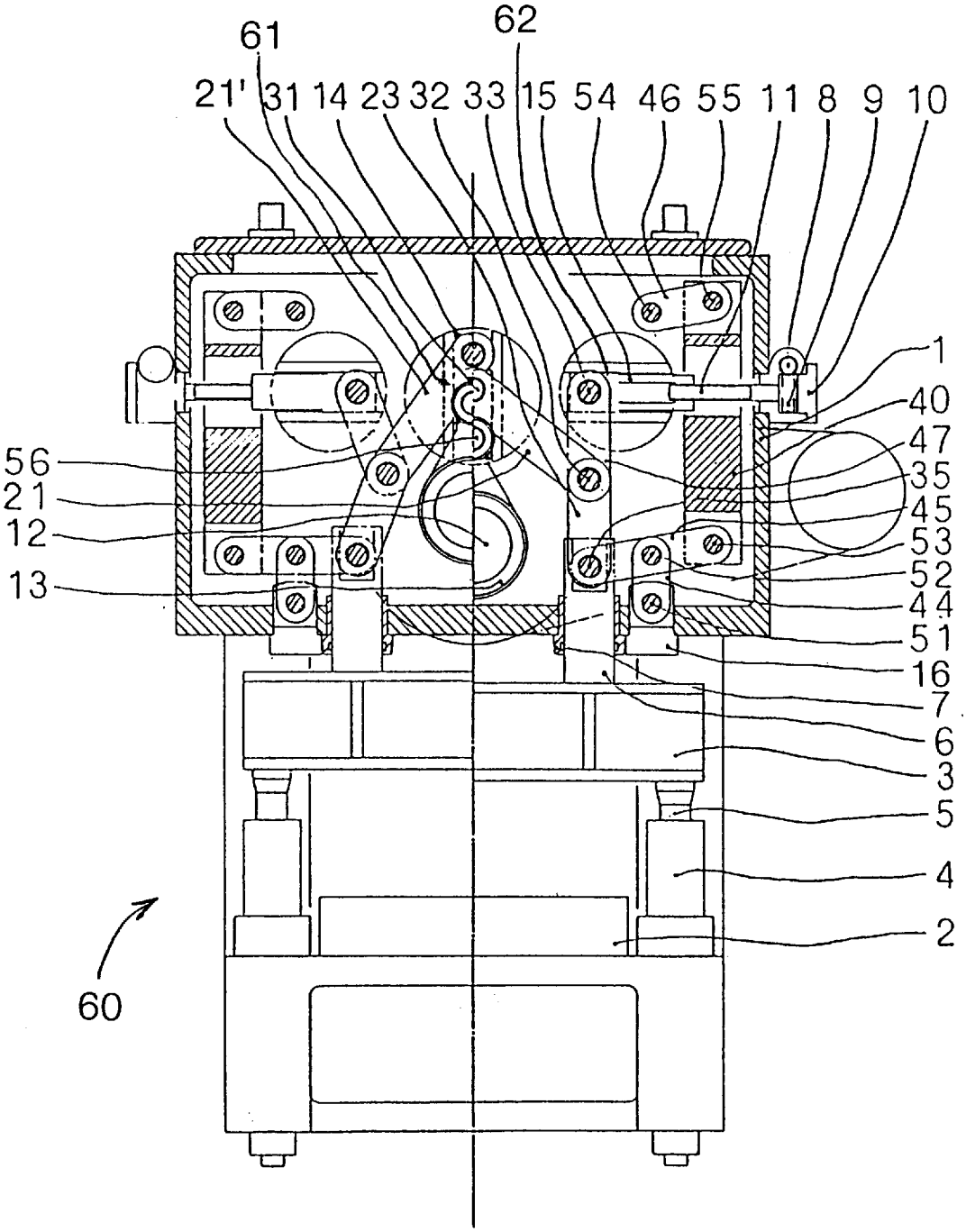
FIG. 1 is a partially cut-away front-view drawing of a link press showing a first embodiment of the device for driving a slide in the link press (the left half of the drawing shows the upper dead point of the slide motion and the right half of the drawing shows the lower dead point of the slide motion).

Referring to FIG. 1, a bolster 2 is fixed to a frame 1 of a machine press 60. A slide 3 is movably mounted within press 60 so that it can be raised and lowered freely. Upper and lower dies (not shown) are set in slide 3 and bolster 2, respectively, to perform a pressing operation. Slide 3 is movable from a lower position, where it meets bolster 2 to an upper position where it is raised above bolster 2.

A pair of slide guide rods 5 are fixed to a bottom of slide 3. Each of slide guide rods 5 is fitted into a slide guide post 4 which is fixed within frame 1. The movement of slide 3 is guided by slide guide rods 5 within guide posts 4. The slide guide rods 5 and guide posts 4 ensure that the upper die mounted on slide 3 meets a lower die mounted on bolster 2 at a precise position each time slide 3 is lowered.

A crank shaft 12, is rotatably connected within frame 1. A large end of a connecting rod 13, which has the large end and a small end, is connected to the crank section of crankshaft 12. The small end of connecting rod 13 is connected to a first slider 14 via pin 56. First slider 14 is movably held in a first groove 61 which is fixed to frame 1 directly above crankshaft 12. First slider 14 is restricted by first groove 61 to vertical movement within first groove 61. First slider 14 in turn is connected to a first right link 21 and a first left link 21' via a first pin 31.

In this embodiment, the small end of connecting rod 13 and first slider 14 are connected via pin 56, and first right link 21 and first left link 21' are connected to first slider 14 via first pin 31. However, the small end of connecting rod 13 could also be connected to first right link 21 and first left link 21' using a single pin.

In this embodiment, a crankshaft 12 is used. However, it is also possible to use an eccentric shaft instead of crankshaft 12 to connect to the large end of connecting rod 13.

When crank shaft 12 is rotated, the large end of connecting rod 13 rotates with the eccentric portion of crankshaft 12. As the large end rotates, the small end of connecting rod 13 and first slider 14 are raised and lowered in first groove 61.

Since the first embodiment of press 60 is symmetrical about the center vertical line of FIG. 1, only the structure of the links on the right half of FIG. 1 will be described.

First right link 21 is connected to a link 47 and a third link 23 with a second pin 32. The other end of link 47 is connected to a second slider 15 which is mounted in frame 1 above second pin 32. Second slider 15 is connected to the other end of link 47 with a first pivot pin 33.

Second slider 15 is movably connected in a second groove 62 formed on frame 1. Second groove 62 guides movement of second slider 15 in a horizontal direction. One end of second slider 15 is threadably connected to a screw shaft 11. A worm wheel 9 is fixed to another end of screw shaft 11. Worm wheel 9 meshes with a worm 8. Worm 8 is rotatably connected to frame 1.

Worm wheel 9 is rotatably supported by cap 10 along an axis of worm wheel 9. Cap 10 restricts worm wheel 9 to one longitudinal position but allows it to rotate when worm 8 is rotated. When worm 8 is rotated, worm wheel 9 rotates causing screw shaft 11 to rotate. Screw shaft 11 rotates within second slider 15 and the rotational motion is transformed into linear motion by the threads of screw shaft 11. That is, a position of second slider 15 is adjusted along second groove 62 as screw shaft 11 is rotated.

The other end of third link 23 is connected to a plunger 6 and one end of a link 45 with a fifth pin 35. Plunger 6 is fixed to an upper portion of slide 3 and is guided by a plunger guide 7 fixed to frame 1. Plunger 6 moves up and down along with slide 3. Therefore, the rotation of crank shaft 12 causes slide 3 to move up and down via connecting rod 13, first right link 21, third link 23, and plunger 6.

A bracket 16 is fixed to a shelf of frame 1 above slide 3. One end of a link 44 is connected on bracket 16. The other end of link 44 is connected to the center of link 45 with a pin 52.

One end of a link 46 is connected to a third pivot pin 54 fixed to frame 1. The other end of link 46 is connected to the upper end of a balance weight 40 with pin 55. Balance weight 40 is used as a counter weight to slide 3 making it easier to raise slide 3.

As discussed above, worm 8 rotates to cause linear movement of second slider 15. The purpose of worm 8 is to change the die height and the stroke length of slide 3. When worm 8 is rotated, worm wheel 9 and screw shaft 11 cause first pivot pin 33 on second slider 15 to be displaced. The displacement of first pivot pin 33 changes the pivot point of link 47. The incline angle of link 47, third link 23, and first right link 21, which together serve as a toggle link, also changes in response to the displacement of first pivot pin 33. These changes alter the die height and the stroke length of slide 3.

Figure 2:
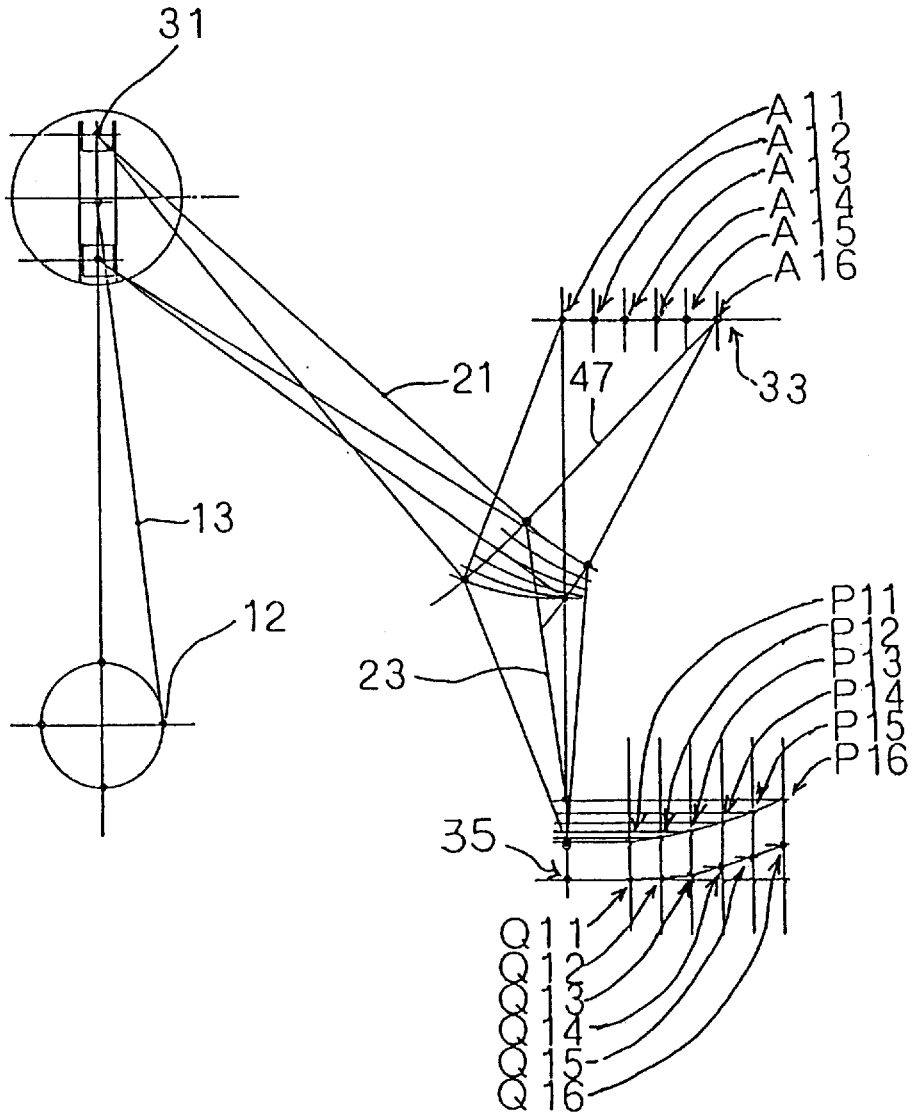
FIG. 2 is a schematic diagram depicting the range of the adjustable stroke length and die height in the first embodiment.

Referring to FIG. 2, first pivot pin 33 is moveable in a range of positions from A11–A16. When first pivot pin 33 is moved from position A11 to position A16 the upper dead point changes from positions P11 to P16 and the lower dead point changes from Q11 to Q16, respectively. The positions of link 47, third link 23 and first link 21 are shown at the upper and lower positions of first slider 14 at the both extreme pivot pin positions A11 and A16. Since the adjustment to first pivot pin 33 is made from outside press 60, fine tuning of the die height and stroke length of press 60 can be accomplished during operation of press 60.

Figure 3:
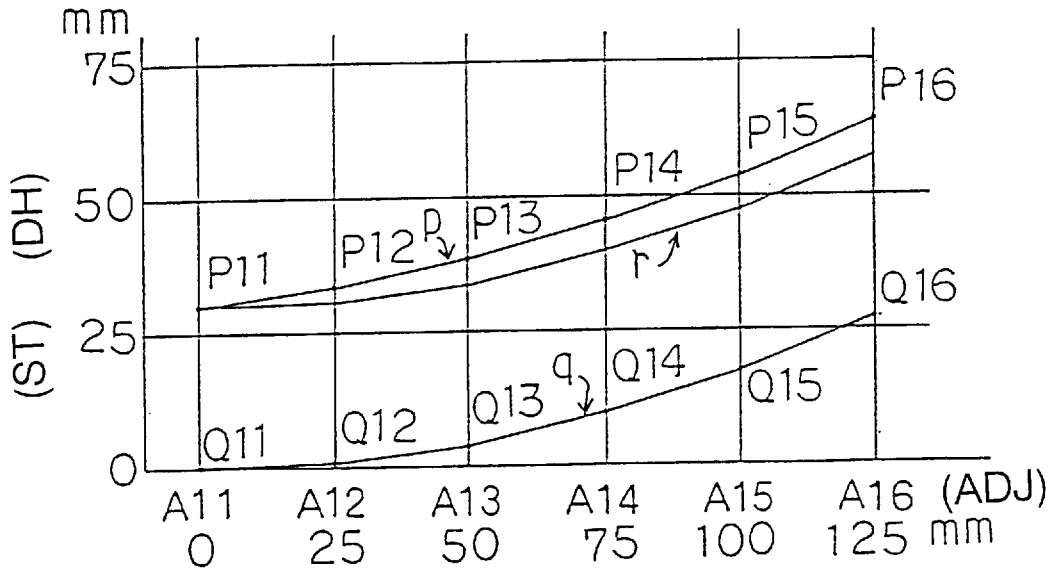
FIG. 3 is a graph depicting the changes in stroke length and die height versus the amount of adjustment in the first embodiment.

Referring to FIG. 3, the horizontal axis represents the displacement of first pivot pin 33, i.e., the amount of adjustment (ADJ). The vertical axis represents the stroke length of the slide (stroke, or St) or the die height (DH). Discrete upper dead point positions P11–P16 are represented by line p and discrete lower dead point positions Q11–Q16 are represented by line q.

Line r is a line that is parallel to q starting at point P11. The difference between lines p and r illustrates the change in the stroke length as a factor of the amount of adjustment (ADJ). As FIG. 3 indicates, the change in stroke length is relatively small compared to the change in die height. Since changes to the stroke length of slider 3 are small, adjustments to first pivot pin 33 can be performed during the operation of press 60.

In this embodiment, the position of first pivot pin 33 is adjustable. However, the initial position of first pivot pin 33 can also be directly fixed anywhere on frame 1.

Figure 4:
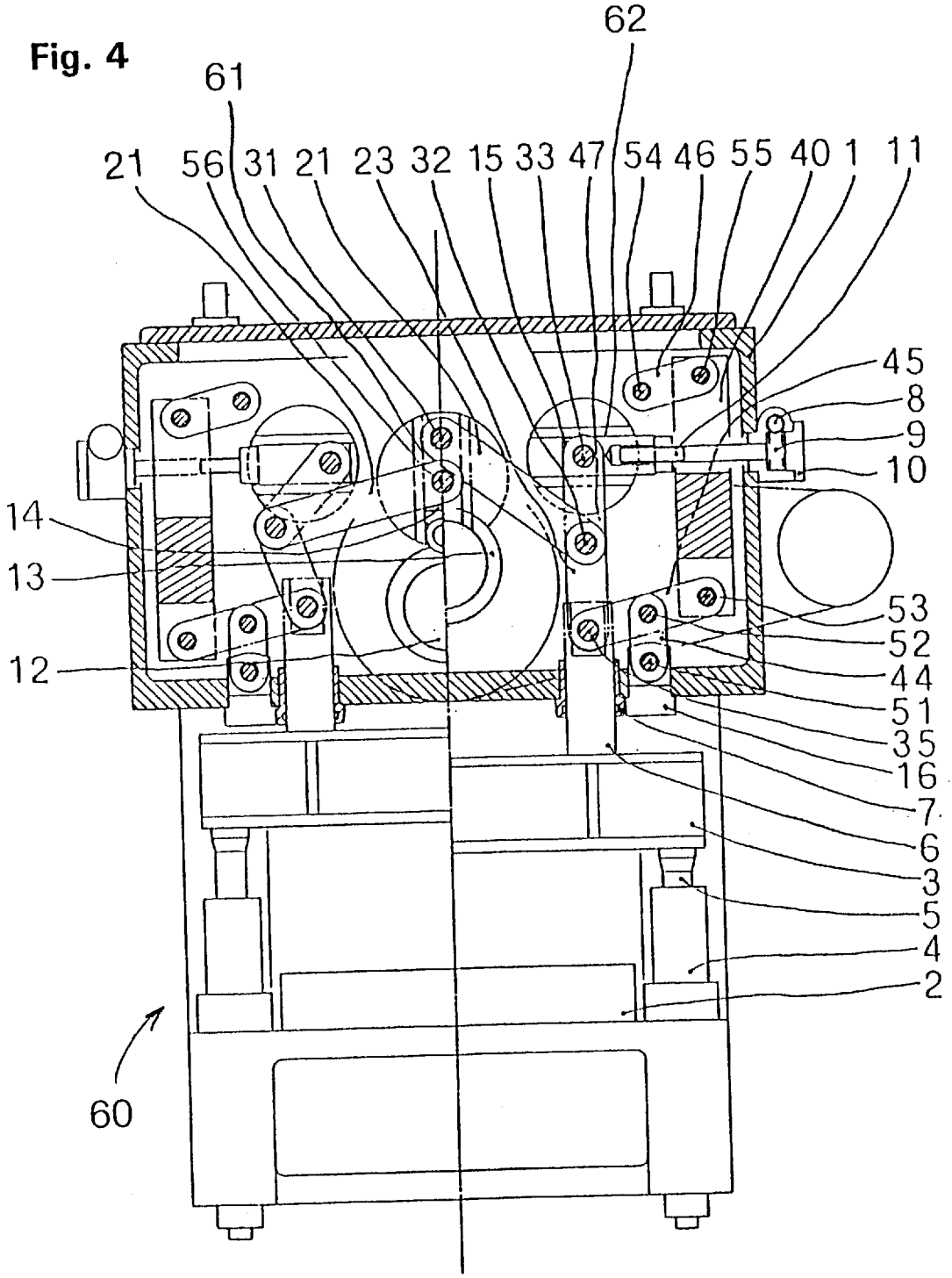
FIG. 4 is a partially cut away front-view drawing of a link press showing a second embodiment of the device for driving a slide in the link press (the left half of the drawing shows the upper dead point and the right half of the drawing shows the lower dead point).

Referring now to FIG. 4, a second embodiment of press 60 of the present invention includes second pin 32 positioned outward from plunger 6. In the first embodiment, second pin 32 is positioned inward from plunger 6 (toward the center of the press). Besides the position of second pin 32, the second embodiment of press 60 is identical in structure to the first embodiment.

Figure 5:
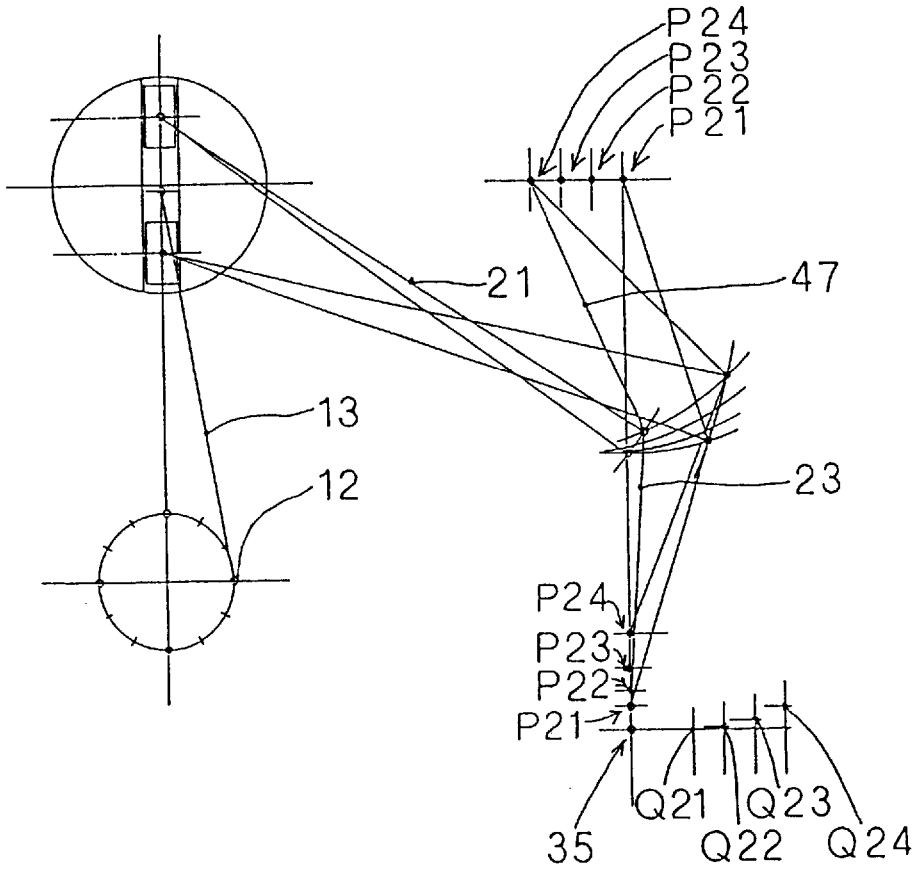
FIG. 5 is a schematic diagram depicting the range of adjustable stroke length and die height in the second embodiment.

Referring to FIG. 5, when first pivot pin 33 is displaced a position A21 to position A24, the upper dead point position changes from P21 to P24 and the lower dead point position changes from Q21 to Q24. The positions of link 47, third link 23 and first link 21 are shown at the upper and lower positions of first slider 14 at the both extreme pivot pin positions A21 and A24.

Figure 6:
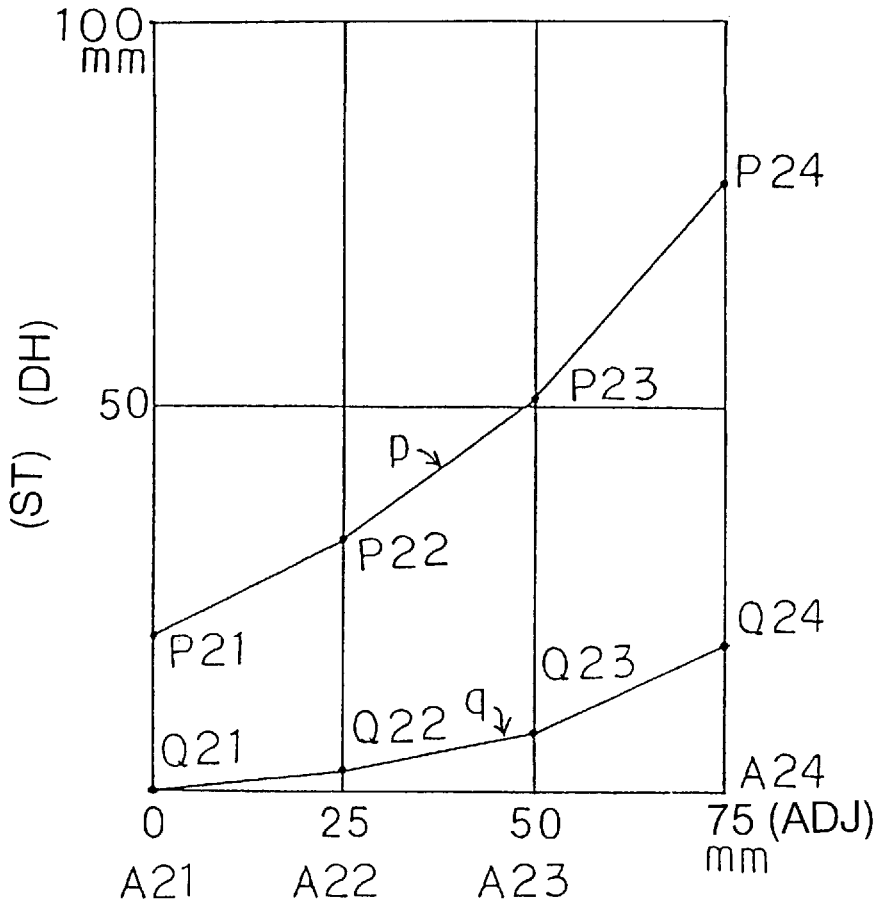
FIG. 6 is a graph depicting the changes in stroke length and die height versus the amount of adjustment in the second embodiment.
Figure 7:
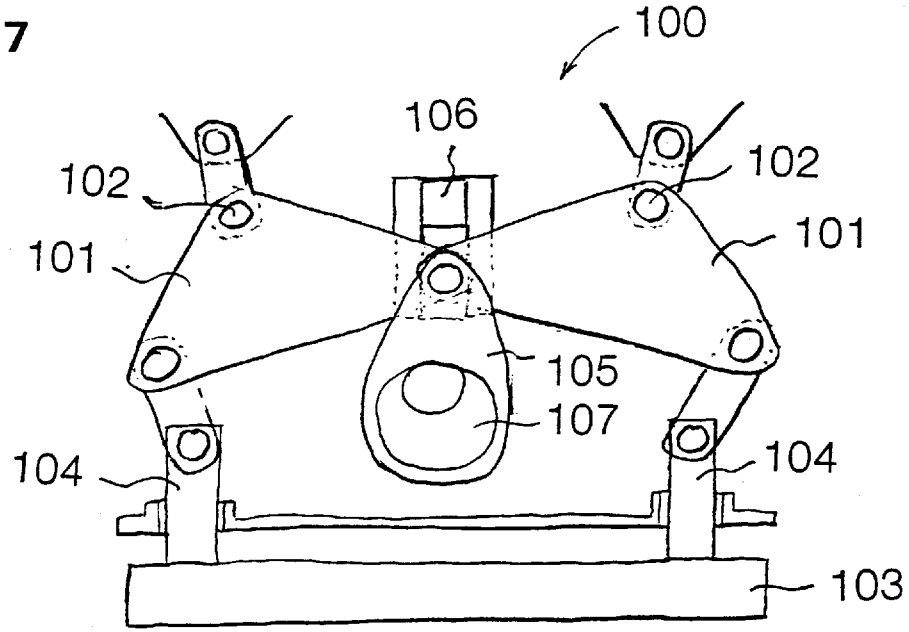
Fig. 7 PRIOR ART
FIG. 7 is a front view drawing of a prior art link press.

Referring to FIG. 6, the horizontal axis represents the amount of displacement of first pivot pin 33, i.e., the amount of adjustment (ADJ). The vertical axis represents the stroke length (stroke, or St) of the slide or the die height (DH).

Discrete upper dead point positions P21 through P24 are represented by line p and discrete lower dead point positions Q21 through Q24 are represented by line q.

The present invention uses straight links instead of prior art bell-crank shaped links. The pivot of the straight links are arranged so that its position is adjustable. Using the described configuration, the distance between the left and right plungers can be decreased. Also, the stroke length of the slide and the lower dead point of the slide is easily adjusted while the press is operating.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A link mechanism for driving a slide in a machine press comprising:

a first portion of said link mechanism vertically movably connected to a frame of said machine press;

a connecting rod having one end connected to said first portion and another end connected to a crankshaft of said machine press, whereby a rotational motion of a crankshaft is transformed into a vertical movement of said first portion;

a second portion of said link mechanism pivotally connected to a pivot pin of said frame;

a position of said pivot pin being adjustable to one of at least a first position and a second position relative to said frame;

a plunger vertically movably mounted in said frame;

a third portion of said link mechanism connected to a top of said plunger;

a bottom of said plunger being connected to said slide; and a stroke length and height of said slide being dependent upon said position of said pivot pin.

2. The link mechanism of claim 1, further including:

a first link having one end vertically movably connected to said machine press;

a second link;

a third link;

said first link being pivotally connected to one end of said second link and one end of said third link;

another end of said second link pivotally connected to said pivot point; and another end of said third link connected to said plunger, wherein, said one end of said first link is said first portion, said another end of said second link is said second portion, and said another end of said third link is said third portion.

3. The link mechanism of claim 1, wherein:

said pivot point is connected to a screw shaft; and rotation of said screw shaft causes a linear displacement of said pivot point parallel to a longitudinal axis of said screw shaft.

4. The link mechanism of claim 3, further including:

a worm wheel connected at one end of said screw shaft; and a worm gear meshed with said worm wheel such that said worm wheel and said screw shaft rotate when said worm gear is rotated.

5. The link mechanism of claim 4, wherein said worm gear is rotatable from a position outside of said machine press.

6. The link mechanism of claim 1, wherein said pivot position is continuously adjustable between said first position and said second position.

7. The link mechanism of claim 1, wherein said pivot position is continuously adjustable along a straight path between said first position and said second position.

8. A link mechanism for driving a slide in a machine press, comprising:

one end of a first link connected to an end of a connecting rod of said machine press, said one end of a first link being vertically movably connected in a frame of said machine press;

a second link;

a third link;

another end of said first link being pivotally connected to one end of said second link and one end of said third link;

another end of said second link being pivotally connected to a pivot pin mounted in said frame; and another end of said third link being pivotally connected to a plunger which is vertically movably connected in said frame, a bottom of said plunger being connected to said slide, such that an up and down motion of said one end of said first link is translated into an up and down motion of said plunger and said slide.

9. The link mechanism of claim 8, wherein a position of said pivot pin is adjustable to one of at least a first position and a second position relative to said frame such that a stroke length and a height of said slide is dependent on said position of said pivot pin.

10. The link mechanism of claim 9, further including a screw shaft threadably connected to said pivot pin such that when said screw shaft is rotated, said pivot pin is moved along the longitudinal axis of said screw shaft.

11. A machine press having a device for driving a slide in said machine press, comprising:

a chassis;

a crankshaft rotatably disposed on said chassis;

one end of a connecting rod connected to said crankshaft;

another end of said connecting rod vertically movably connected to said chassis;

a first link mechanism, said first link mechanism including;

a first portion of said first link mechanism connected to said another end of said connecting rod;

a first pivot pin disposed on said chassis, a position of said first pivot pin being adjustable to one of at least a first position and a second position relative to said machine press;

a second portion of said first link mechanism pivotally connected to said pivot pin; and a plunger fixed to said slide and guided by said chassis;

a third portion of said first link mechanism connected to a top of said plunger, such that an up and down motion of said first portion is translated to and up and down motion of said plunger and said slide, a stroke length and height of said slide being dependent on said position of said first pivot pin.

12. The machine press of claim 11, further including a second link mechanism, said second link mechanism being symmetrical to said first link mechanism about a center line of said slide.

13. The machine press of claim 11, wherein said first link mechanism further includes:

a first link having one end connected to said slide;

a second link;

a third link;

said first link being pivotally connected to one end of said second link and one end of said third link;

another end of said second link pivotally connected to said pivot point; and another end of said third link connected to said plunger, wherein, said one end of said first link is said first portion, said another end of said second link is said second portion, and said another end of said third link is said third portion.

14. The machine press of claim 13, further including a second link mechanism, said second link mechanism being symmetrical to said first link mechanism about a center line of said first slide.

15. A device for driving a slide in a press that uses links, comprising:

a crank shaft rotatably disposed on a chassis of said press;

a connecting rod having a large end connected to said crank shaft;

a first slider movably guided by a groove disposed on said chassis above said crank shaft and connected to a small end of said connecting rod;

one end of a first link connected to said slider;

one end of a second link and one end of a third link connected to another end of said first link;

a pivot pin connected to another end of said second link;

a plunger fixed to said slide and guided by said chassis, said plunger being connected to another end of said third link; and a position of said pivot pin being adjustable on said chassis between at least a first position and a second position on said chassis such that a stroke length and a height of said slide are dependent on said position of said pivot pin.

* * * * *